US008056375B2

(12) United States Patent
Gracia Bobed

(10) Patent No.: US 8,056,375 B2
(45) Date of Patent: Nov. 15, 2011

(54) METHOD FOR FIXING THE DRUM OF A WASHING MACHINE AND FITTING FOR THE SAME

(75) Inventor: Ismael Gracia Bobed, Zaragoza (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 12/849,856

(22) Filed: Aug. 4, 2010

(65) Prior Publication Data

US 2010/0294005 A1 Nov. 25, 2010

Related U.S. Application Data

(60) Division of application No. 11/037,635, filed on Jan. 18, 2005, now Pat. No. 7,841,800, which is a continuation of application No. PCT/EP03/07437, filed on Jul. 9, 2003.

(30) Foreign Application Priority Data

Jul. 19, 2002 (ES) ..... 200201803

(51) Int. Cl.
*D06F 21/00* (2006.01)

(52) U.S. Cl. ..... 68/140; 403/274

(58) Field of Classification Search ..... 68/139, 68/140, 142

See application file for complete search history.

(56) References Cited

U.S. PATENT DOCUMENTS

| | | | | |
|---|---|---|---|---|
| 1,472,434 | A | | 10/1923 | Oberg |
| 2,289,162 | A | * | 7/1942 | Amonsen ..... 68/140 |
| 2,415,695 | A | | 2/1947 | Cann |
| 2,816,742 | A | | 12/1957 | Richterkessing et al. |
| 2,925,665 | A | | 2/1960 | Smith |
| 5,433,091 | A | | 7/1995 | Durazzani et al. |
| 5,740,589 | A | | 4/1998 | Dominguez |
| 6,279,357 | B1 | | 8/2001 | Didlick et al. |
| 6,297,961 | B1 | | 10/2001 | Koizumi et al. |
| 6,401,363 | B1 | | 6/2002 | Miramondi |
| 6,502,295 | B1 | | 1/2003 | Morgand |

FOREIGN PATENT DOCUMENTS

| | | | |
|---|---|---|---|
| AT | 172176 | A | 8/1995 |
| DE | 3041506 | A1 | 6/1982 |
| DE | 3905495 | A1 | 9/1989 |
| DE | 4326676 | A1 | 2/1994 |
| DE | 4326496 | A1 | 2/1995 |
| DE | 19532783 | A1 | 3/1996 |
| EP | 0854223 | A2 | 7/1998 |
| FR | 2752886 | A1 | 3/1998 |
| GB | 1388731 | A | 3/1975 |
| GB | 2178067 | A | 2/1987 |

* cited by examiner

*Primary Examiner* — Michael Barr

*Assistant Examiner* — David Cormier

(74) *Attorney, Agent, or Firm* — James E. Howard; Andre Pallapies

(57) ABSTRACT

A drum is fixed to a mounting star, on which a shaft for drive of the drum is fixed. The fixing is achieved by means of arrangement of several openings in the mounting star with different entry and exit diameters, whereby a tip corresponding to each opening is arranged on the drum, which is introduced through the smallest hole in the opening. The tip is subsequently deformed such that the outer surface thereof is pressed against at least the walls of the opening, whereupon the fixing is generated.

30 Claims, 4 Drawing Sheets

METHOD FOR FIXING THE DRUM OF A WASHING MACHINE AND FITTING FOR THE SAME

CROSS REFERENCE TO RELATED APPLICATIONS

This application is a Divisional, under 35 U.S.C. §121, of U.S. application Ser. No. 11/037,635, filed Jan. 18, 2005, which is a continuation, under 35 U.S.C. §120, of International Application No. PCT/EP2003/007437, filed Jul. 9, 2003, which designated the United States; this application also claims the priority, under 35 U.S.C. §119, of Spanish Patent Application No. P200201803, filed Jul. 19, 2002.

OBJECT OF THE INVENTION

The invention relates to a method for fixing the rear wall of a drum of a washing machine on a mounting star, on which the drum is swivel-mounted via an axis and fixing, which is achieved by means of the method. The object of the invention is to provide fixing with features which enable greater loads to be endured when the drum is rotating, especially in washing machines which tumble at high speeds.

GENERAL PRIOR ART

It is known that drums of washing machines with rotation capacity are arranged in the interior of a container, for which purpose they are attached on a mounting (known as mounting star), which is connected to a rotating axis, powered by a suitable motor. The mounting star is star shaped, and its mounting arms are fixed on the drum. A known embodiment for fixing the mounting arms on the drum provides screwing the ends of the mounting arms on a peripheral projection, formed on the rear wall of the drum.

In the past the decision has been made to rivet the end of each mounting arm of the mounting star on the rear wall of the drum itself instead of the screw connections on the peripheral projection and by means of a metallic reinforcing plate, by means of which the bond for mounting the drum is made.

DESCRIPTION OF THE INVENTION

These known methods of fixing have disadvantages. In the first case the loads, which occur when the drum rotates at high speeds, are absorbed by the points, at which the connection of the end of the mounting arms is made with the peripheral projection of the drum. This can, especially with high-speed tumbling, cause tearing in the drum, or the mounting points cannot withstand the loads at high speeds.

In the second case the necessary metallic reinforcing plates are cause for high costs of the fixing method. Also, there is only fixing for each of the mounting arms of the mounting star, whereby the mounting points for drums rotating at high tumbling speeds are not solid enough despite the strengthening by the reinforcing plate.

In order to eliminate the abovementioned disadvantages the object of the invention is to develop a novel fixing method for the drum of a washing machine, in which the mounting star for the rotating axis and its fixing are less expensive but still more stable.

The method according to the invention solves this task in that the rear wall of the drum on the mounting star is attached at several openings of the mounting star with entry and exit diameters of differing size, in that for each opening a tip is drawn through the entry with the smaller diameter from the sheet of the rear wall of the drum in the assigned opening, in that then the tip is widened out against the walls of the opening, which establish the major difference between the entry and exit diameters of the opening.

The inventive method provides that deformation of the already drawn tip is made by use of a press tool, in that the press tool with a complementary surface matching the truncated surface of the late tip form is guided through the larger hole and the upper part of the tip and presses against the inside of the tip, resulting in its final form.

The method of the invention can be applied to any configuration of the mounting star. But since the latter conventionally has a star shape, the inventive method provides that there is at least one opening for a tip provided in the drum rear wall in each mounting arm of the star.

In an embodiment of the invention the walls of the opening, against which the corresponding tip of the drum presses, have a surface which widens in the direction of the upper end of the tip, such that when the tip deforms the latter opens in the direction of said surface and presses against the surface. This produces the fixing between the mounting star and the drum.

Widening of the walls of the opening, against which the tip presses, can take on any configuration. In the preferred embodiment it has a truncated shape, preferably in its entirety determined by the tip.

There is also the possibility that the walls of the opening, which determine the major difference between the entry and exit diameters and against which the respective tip of the drum presses, contain at least one graduation, to which the tip adapts when deforming and pressing.

A further embodiment contains in the truncated area of the opening several graduations for fixing the drum even more securely.

Obviously, in each mounting arm of the mounting star a sufficiently large number of holes can be made, as is adapted to the demands made on the drum depending on the desired tumbling speed, and in this way fixing takes place at different sites on the mounting arms.

In addition, the method according to the invention offers the possibility, to add at least one lateral widening at least in an area of the mounting arms, in which at least one opening is made, in which a corresponding tip of the drum is held. Where the mounting star is configured as a star-shaped component at least one lateral widening is arranged at the lateral ends of each mounting arm.

The inventive method can provide that the tip of the drum is designed by means of a press-in process.

The fixing obtained by means of the method of the invention is characterised in that the mounting star has several openings with various entry and exit diameters, in which in each case one tip is inserted from the smaller entry diameter, which is drawn from the rear wall of the drum, such that the tip presses at least against that area of the walls of the opening, which determine the differences between the entry and exit diameters.

The walls of the opening of the mounting star, with which the fixing is executed, as well as the mounting star itself and the drum exhibit those features which have already been described in the method according to the invention.

Hereinbelow a series of figures is attached, in which the object of the invention is explained and illustrated in a non-limiting way for better comprehension of the description and as part thereof.

DETAILED DESCRIPTION OF THE INVENTION

A drum 1 and a mounting star 2 are partially illustrated in the figures. Because these are well-known elements, a complete illustration of all these elements was omitted.

The drum 1 is fixed on the outside of its rear wall on the mounting arms 3 of the mounting star 2, which is configured star shaped.

The mounting star 2 for its part is connected solidly to a shaft 4, which is connected to a drive motor (not illustrated here) to generate the rotation of the drum 1 in a lye container, not illustrated.

Figure 4:
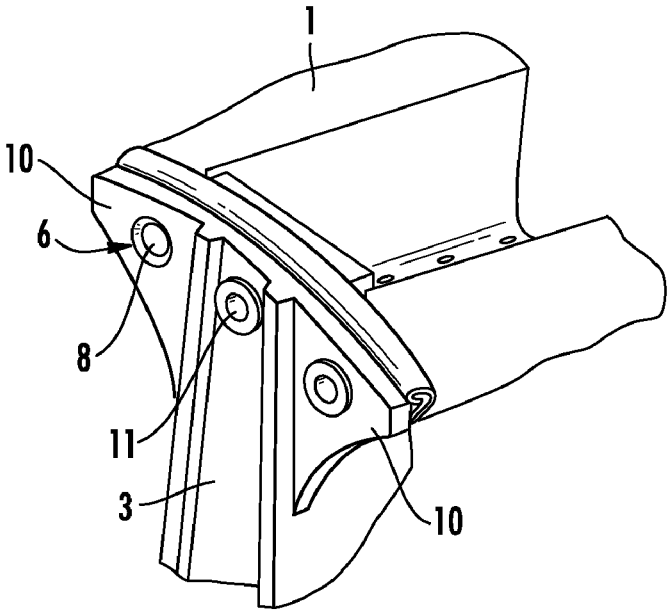
FIG. 4 is a perspective partial view of another embodiment of the ends of the mounting arms, in each of which a lateral widening is started, which is fixed by means of the inventive method on the drum, and this figure also shows the fixing of the end of the mounting arm, in which the fixing is strengthened by means of conventional riveting and a metal plate.
Figure 5:
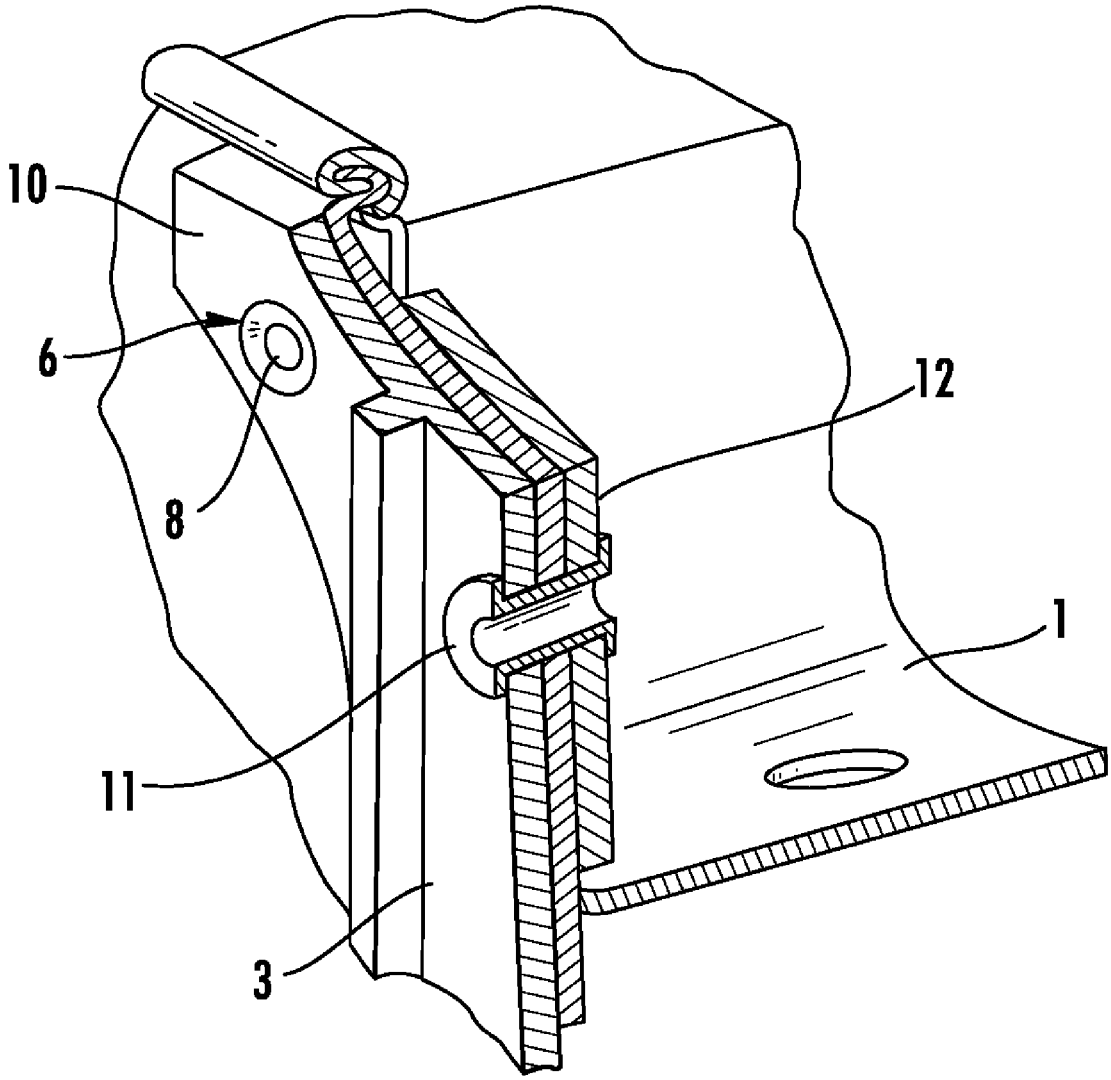
FIG. 5 shows a detail from the example of FIG. 4, in which the fixing is strengthened by conventional means and by a metal plate.

The rear wall of the drum 1 is fitted with grooving 5 in a star shape, in which the mounting arms 3 of the mounting star 2 are situated. One of the fixings, which are conventionally used to connect the ends of the mounting arms 3 of the mounting star 2 to the drum 1, comprise attaching a rivet 11 (FIGS. 4 and 5) by means of interposing a metal plate 12, which reinforces the connection, as insufficiently described above by way of the prior art as for washing machines, which tumble at a very high speed. For this reason the invention proposes an alternative or complementary fixing to the fixing produced by conventional means, for which reason at least one opening 6 with a wall having a truncated shape is designed in each mounting arm 3 of the mounting star 2, which determine an entry of greater diameter than the exit.

Figure 1:
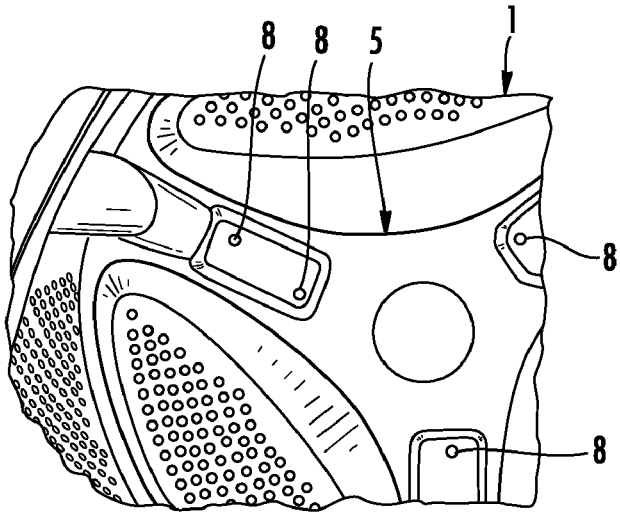
FIG. 1 is a perspective partial view of the interior of the drum, on the rear of which the tips are recognisable, which are designed by pressing in for fixing of the mounting star and which are located on the outside of the drum.
Figure 2A:
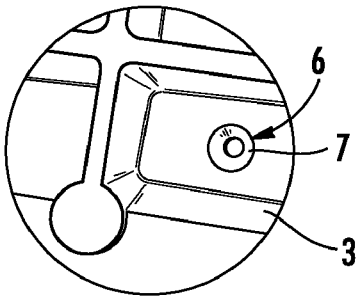
FIGS. 2*a* and 2*b* are a perspective partial view of the outside of the drum and of one of the mounting arms of the mounting star, on which it is fixed, whereby a detail of the opening is also to be seen, which is placed in the mounting star for configuring the fixing of the tip of the drum.
Figure 2B:
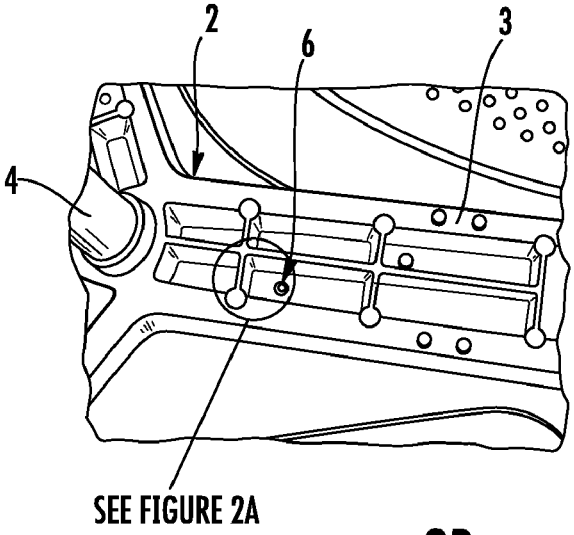
Figure 3A:
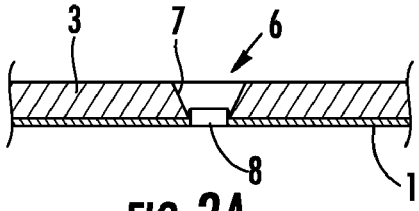
FIGS. 3*a* to 3*d* are a schematic illustration of the different sequences provided by the inventive method for carrying out the fixing of the mounting star with the drum.
Figure 3B:
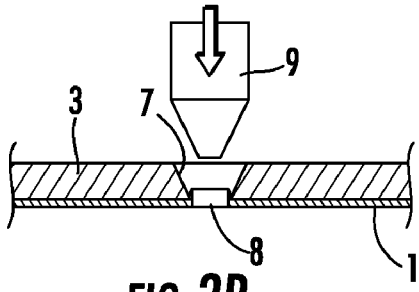

In the embodiment two openings are made for in each case one of the mounting arms, but there is the possibility of arranging one opening or more as two, depending on the loading of the drum caused by the tumbling speed. Arranged on the rear wall of the drum 1 and the number of openings 6 are one or more tips 8, which project outwards, so that each tip 8 can be housed in the opening 6, as in FIG. 3*a*. The tip 8 can be created by pressing or drawing from the inside of the rear wall of the drum 1.

Figure 3C:
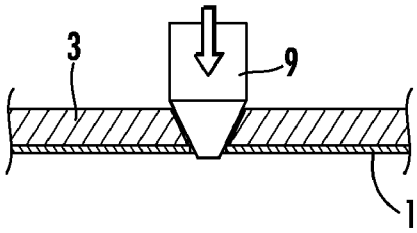
Figure 3D:
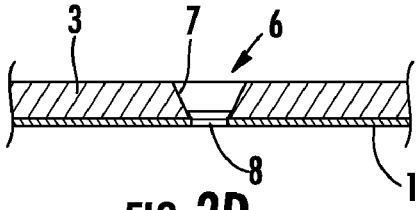

When the tip 8 is introduced into the opening 6, a drift punch 9 is guided through the outside (greater diameter) of the opening 6, whereby the drift punch 9 a truncated mantle surface has, which corresponds to the truncated surface 7 of the opening 6. When the drift punch 9 lowers its lower end enters the tip 8, so that the tip 8 widens until it presses against the truncated walls 7 of the opening 6 (FIG. 3*c*), so that when the drift punch 9 is removed (FIG. 3*d*) the fixing of the drum 1 on the mounting star 2 is completed. In this way fixing with several mounting points is achieved, which share the load, thus guaranteeing greater resistance.

Figure 6A:
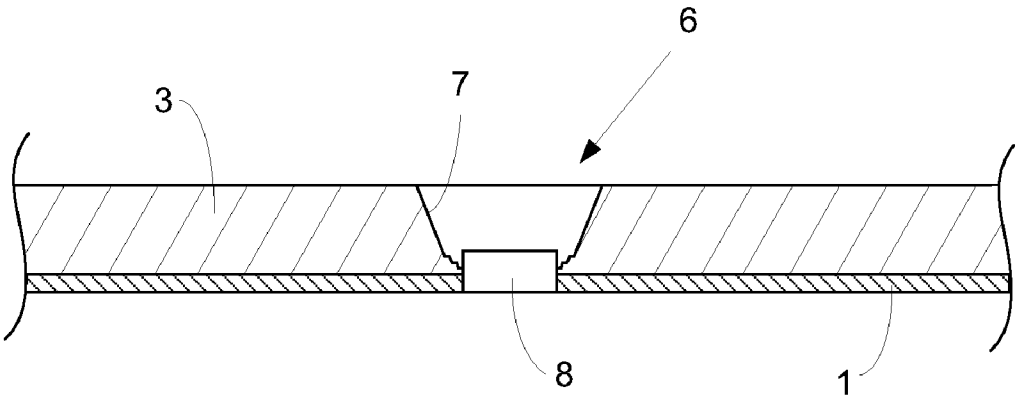
FIGS. 6A and 6B are schematic illustrations of different sequences provided by an exemplary method of fixing the mounting star with the drum.
Figure 6B:
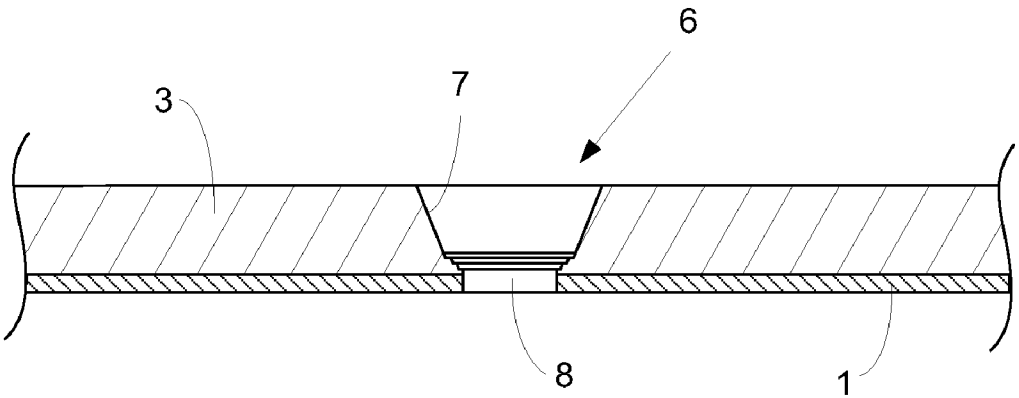

As shown in FIGS. 6A and 6B, the truncated wall 7 can contain a graduation. In this case the drift punch 9 must contain a corresponding graduation, to be able to exert the correct and as far as possible whole-surface pressure with respect to the tip 8 on the walls of the opening 6.

The invention also provides that, if wanted, for greater loads respective widening 10 can be provided at the ends of the mounting arms 3 of the mounting star, in which there is at least one opening 6, to execute the fixing according to the invention, whereby also a conventional connection can be provided by means of the abovementioned rivet 11.

What is claimed is:

1. A method of fixing a rear wall of a drum of a washing machine to a rotatable mounting fixture of the washing machine, wherein the washing machine includes a housing, the rotatable mounting fixture being rotatably supported within the housing for rotation about an axis, and the drum being connected to the mounting fixture such that the drum is rotatable about the axis by the rotatable mounting fixture, the method comprising:

providing a plurality of openings extending through the rotatable mounting fixture, each of the plurality of openings having a larger end and a smaller end and a wall connecting the larger end to the smaller end, in which a cross-sectional area of the larger end is greater than a cross-sectional area of the smaller end, wherein each of the plurality of openings has a truncated cross-sectional shape;

providing a plurality of tips extending outwardly from the rear wall of the drum, each of the plurality of tips having an end disposed opposite the drum;

drawing each of the plurality of tips through the smaller end of each of the plurality of openings and toward the larger end; and widening each of the plurality of tips outward against the wall of each of the plurality of openings, each of the plurality of tips extending at least partially into each of the plurality of openings of the rotatable mounting fixture through the smaller end of the opening and the end of each of the plurality of tips extending radially outwardly beyond the smaller end of each of the plurality of openings, wherein each of the plurality of tips has a truncated cross-sectional shape corresponding to the truncated cross-sectional shape of each of the plurality of openings, to fix the rear wall of the drum to the rotatable mounting fixture and transmit rotation of the rotatable mounting fixture to the drum.

2. The method as claimed in claim 1, wherein the widening of each of the plurality of tips, which has already been drawn through the smaller end of each of the plurality of openings is caused by use of a press tool, wherein the press tool includes a complementary surface matching a truncated surface of the widened tip, and wherein the press tool is guided through the larger end of each of the plurality of openings of the rotatable mounting fixture and an upper part of the end of each of the plurality of tips of the drum, and wherein the press tool presses against an inside of each of the plurality of tips of the drum, thereby creating a final form of each of the plurality of tips of the drum.

3. The method as claimed in claim 1, wherein the walls of the opening have at least a combination having a truncated surface and at least a graduation, and wherein the complementary surface of the press tool forms parts of the combination.

4. The method as claimed in claim 1, wherein the rotatable mounting fixture has a star-shaped configuration of mounting arms each including at least one opening, in which a corresponding tip of the plurality of tips of the drum is drawn.

5. The method as claimed in claim 1, wherein each of the plurality of tips of the drum is made by a press-in process.

6. A method of mounting a drum of a washing machine to a rotatable mounting fixture of the washing machine, wherein the washing machine includes a housing, the rotatable mounting fixture being rotatably supported within the housing for rotation about an axis, and the drum being connected to the mounting fixture such that the drum is rotatable about the axis by the rotatable mounting fixture, the method comprising:

providing at least one opening extending through the rotatable mounting fixture, the at least one opening having a larger end and a smaller end and a truncated internal surface connecting the larger end to the smaller end, in which a cross-sectional area of the larger end is greater than a cross-sectional area of the smaller end, wherein each of the plurality of openings has a truncated cross-sectional shape;

providing at least one tip extending outwardly from the drum, wherein the tip includes an end disposed opposite the drum, the end of the tip opposite the drum at least partially defining a cavity;

aligning the tip of the drum with the opening of the rotatable mounting fixture;

inserting the tip into the smaller end of the opening such that the tip is at least partially disposed within the opening of the rotatable mounting fixture; and widening the tip outwardly toward the truncated internal surface of the opening of the rotatable mounting fixture, the tip extending at least partially into the opening of the rotatable mounting fixture through the smaller end of the opening and the end of the tip extending radially outwardly beyond the smaller end of the opening, wherein the tip has a truncated cross-sectional shape corresponding to the truncated cross-sectional shape of the opening, to couple the drum to the rotatable mounting fixture and transmit rotation of the rotatable mounting fixture to the drum.

7. The method as claimed in claim 6, wherein the widening the tip further comprises:

inserting a press tool into the larger end of the opening of the rotatable mounting fixture to press the tip of the drum against the truncated internal surface of the opening of the rotatable mounting fixture.

8. The method as claimed in claim 7, wherein the press tool has a truncated external surface substantially corresponding to the truncated internal surface of the opening of the rotatable mounting fixture.

9. The method as claimed in claim 6, wherein the rotatable mounting fixture includes a star-shaped configuration having multiple arms extending radially outwardly from a shaft and each arm includes at least one opening, and the drum includes a tip corresponding to at least one opening on each arm, the aligning the tip of the drum with the opening of the rotatable mounting fixture further comprising:

aligning each tip on the drum with the corresponding opening on the arms of the rotatable mounting fixture.

10. The method as claimed in claim 6, wherein the providing at least one tip further comprises:

making the tip of the drum with a press-in process.

11. A washing machine comprising:

a housing;

a rotatable mounting fixture rotatably supported within the housing for rotation about an axis, the rotatable mounting fixture having at least one opening extending through the rotatable mounting fixture, the opening having a larger end and a smaller end, in which a cross-sectional area of the larger end is greater than a cross-sectional area of the smaller end, wherein the at least one opening has a truncated cross-sectional shape; and a drum connected to the mounting fixture and rotatable about the axis by the rotatable mounting fixture, the drum having at least one tip extending outwardly from the drum, the tip having an end disposed opposite the drum, the tip extending at least partially into the opening of the rotatable mounting fixture through the smaller end of the opening and the end of the tip extending radially outwardly beyond the smaller end of the opening, wherein the tip has a truncated cross-sectional shape corresponding to the truncated cross-sectional shape of the at least one opening and that fixes the drum to the rotatable mounting fixture and transmits rotation of the rotatable mounting fixture to the drum.

12. The washing machine as claimed in claim 11, wherein the opening having the truncated cross-sectional shape defines an inner surface having a truncated cross-sectional shape, and wherein the tip having the corresponding truncated cross-sectional shape defines an external surface having a truncated cross-sectional shape engaging the inner surface and resisting the tip of the drum from exiting the opening of the rotatable mounting fixture.

13. The washing machine as claimed in claim 11, wherein the rotatable mounting fixture includes a rotatable mounting star having multiple arms extending radially outwardly from a shaft and each arm having at least one opening, each opening having a smaller end and a larger end, the drum including multiple tips extending outwardly from the drum, one of the tips extending at least partially into a corresponding opening on each arm through the smaller end and extending radially outwardly beyond the smaller end of the corresponding opening.

14. The washing machine as claimed in claim 11, wherein the rotatable mounting fixture includes a rotatable mounting star having multiple arms extending radially outwardly from a shaft, wherein each arm includes at least one opening, each opening having a smaller end and a larger end and a truncated cross-sectional shape, wherein the drum includes a plurality of tips extending outwardly from the drum, one of the tips extending at least partially into a corresponding opening on each arm through the smaller end and extending radially outwardly beyond the smaller end of the corresponding opening, and wherein the truncated cross-sectional shape of the tip of the drum corresponds to the truncated cross-sectional shape of the corresponding opening of the rotatable mounting fixture.

15. The washing machine as claimed in claim 11, wherein the opening having the larger end and the smaller end, in which the cross-sectional area of the larger end is greater than the cross-sectional area of the smaller end, continuously decreases in cross-sectional area from the larger end of the opening to the smaller end of the opening of the rotatable mounting fixture.

16. The washing machine as claimed in claim 11, wherein a cross-sectional area of the tip of the drum continuously decreases in cross-sectional area from the larger end of the opening to the smaller end of the opening of the rotatable mounting fixture.

17. The washing machine as claimed in claim 11, wherein the opening having the larger end and the smaller end, in which the cross-sectional area of the larger end is greater than the cross-sectional area of the smaller end, defines an inner surface having a graduated shape that incrementally decreases in cross-sectional area from the larger end of the opening to the smaller end of the opening of the rotatable mounting fixture.

18. The washing machine as claimed in claim 17, wherein the tip defines an external surface having a graduated shape that corresponds to the graduated shape of the opening of the rotatable mounting fixture.

19. The washing machine as claimed in claim 11, further comprising:

a rivet, wherein the drum includes a rivet opening, wherein the rotatable mounting fixture includes a rivet opening corresponding to the rivet opening of the drum, and wherein the rivet extends through the rivet opening of the rotatable mounting fixture and the rivet opening of the drum.

20. The washing machine as claimed in claim 19, further comprising:

a plate disposed on an opposite side of the drum from the rotatable mounting fixture and at a location corresponding to the rivet opening of the drum, wherein the plate includes a rivet opening corresponding to the rivet opening of the drum, and wherein the rivet extends through the rivet opening of the rotatable mounting fixture, the rivet opening of the drum, and the rivet opening of the plate.

21. The washing machine as claimed in claim 11, wherein the rotatable mounting fixture includes a rotatable mounting star having a plurality of arms extending radially outwardly from a shaft, wherein each of the plurality of arms has an opening extending through the rotatable mounting star, wherein the opening has a larger end and a smaller end, in which a cross-sectional area of the larger end is greater than a cross-sectional area of the smaller end, and wherein the opening has a truncated cross-sectional shape, wherein the drum includes a plurality of tips extending outwardly from a rear wall of the drum and having an end disposed opposite of the rear wall of the drum, wherein each tip of the plurality of tips is aligned with a corresponding opening of each of the plurality of arms, and wherein each tip of the plurality of tips extends through the smaller end of the corresponding opening of the plurality of arms and has a truncated cross-sectional shape corresponding to the truncated cross-sectional shape of the corresponding opening to fix the drum to the rotatable mounting star and transmit rotation of the rotatable mounting star to the drum.

22. The washing machine as claimed in claim 11, wherein the rotatable mounting fixture includes a rotatable mounting star having a plurality of arms extending radially outwardly from a shaft, wherein each of the plurality of arms has a plurality of openings extending through the rotatable mounting star, wherein each opening of the plurality of openings has a larger end and a smaller end, in which a cross-sectional area of the larger end is greater than a cross-sectional area of the smaller end, and wherein the opening has a truncated cross-sectional shape, wherein the drum includes a plurality of tips extending outwardly from a rear wall of the drum and having an end disposed opposite of the rear wall of the drum, wherein each tip of the plurality of tips is aligned with a corresponding opening of the plurality of openings of the plurality of arms, and wherein each tip of the plurality of tips extends through the smaller end of the corresponding opening of the plurality of openings and has a truncated cross-sectional shape corresponding to the truncated cross-sectional shape of the corresponding opening and fixes the drum to the rotatable mounting star and transmits rotation of the rotatable mounting star to the drum.

23. The washing machine as claimed in claim 21, wherein each of the plurality of arms includes a widening portion at an opposite end from the shaft, wherein the widening portion includes an opening extending through the widening portion of the rotatable mounting star, wherein the opening has a larger end and a smaller end, in which a cross-sectional area of the larger end is greater than a cross-sectional area of the smaller end, and wherein the opening has a truncated cross-sectional shape, wherein one of the plurality of tips is aligned with the opening of the widening portion, and wherein the one of the plurality of tips extends through the smaller end of the opening of the widening portion and has a truncated cross-sectional shape corresponding to the truncated cross-sectional shape of the opening of the widening portion and fixes the drum to the widening portion of the rotatable mounting star and transmits rotation of the rotatable mounting star to the drum.

24. The washing machine as claimed in claim 23, further comprising:

a rivet, wherein the rear wall of the drum includes a rivet opening and an arm of the plurality of arms includes a rivet opening corresponding to the rivet opening of the drum, and wherein the rivet extends through the rivet opening of the arm and the rivet opening of the drum.

25. The washing machine as claimed in claim 21, wherein each arm of the plurality of arms has a pair of widening portions extending in opposite directions from an opposite end of the arm from the shaft, wherein each widening portion of the pair of widening portions includes an opening extending through the widening portion, wherein the opening has a larger end and a smaller end, in which a cross-sectional area of the larger end is greater than a cross-sectional area of the smaller end, and wherein the opening has a truncated cross-sectional shape, wherein one of the plurality of tips is aligned with the opening of each widening portion of the pair of widening portions, and wherein the one of the plurality of tips extends through the smaller end of the opening of each widening portion of the pair of widening portions and has a truncated cross-sectional shape corresponding to the truncated cross-sectional shape of the opening of each widening portion of the pair of widening portions and fixes the drum to the widening portion of the rotatable mounting star and transmits rotation of the rotatable mounting star to the drum.

26. The washing machine as claimed in claim 25, further comprising:

a rivet, wherein the rear wall of the drum includes a rivet opening, wherein the arm having the pair of widening portions includes a rivet opening disposed between the pair of widening portions and corresponding to the rivet opening of the drum, and wherein the rivet extends through the rivet opening of the arm and the rivet opening of the drum.

27. The washing machine as claimed in claim 24, wherein one of the plurality of openings is disposed along a length of an arm of the plurality of arms between the shaft and an end of the arm opposite of the shaft.

28. The washing machine as claimed in claim 24, wherein a plurality of openings is disposed along a length of an arm of the plurality of arms between the shaft and an end of the arm opposite of the shaft.

29. The washing machine as claimed in claim 26, wherein one of the plurality of openings is disposed along a length of an arm of the plurality of arms between the shaft and an end of the arm opposite of the shaft.

30. The washing machine as claimed in claim 26, wherein a plurality of openings is disposed along a length of an arm of the plurality of arms between the shaft and an end of the arm opposite of the shaft.

* * * * *